US006116949A

United States Patent [19]

Costello et al.

[11] Patent Number: 6,116,949

[45] Date of Patent: Sep. 12, 2000

[54] ELECTROSTATIC PROTECTION COVER FOR ELECTRICAL CONNECTOR

[75] Inventors: Brian Patrick Costello, Scotts Valley, Calif.; Mitchell Minh Trinh, Singapore, Singapore

[73] Assignee: The Whitaker Corporation, Wilmington, Del.

[21] Appl. No.: 09/229,259

[22] Filed: Jan. 13, 1999

[51] Int. Cl.[7] ..... H01R 31/08

[52] U.S. Cl. ..... 439/509; 439/940

[58] Field of Search ..... 439/940, 181, 439/507, 135, 509

[56] References Cited

U.S. PATENT DOCUMENTS

| | | | |
|---|---|---|---|
| 4,396,245 | 8/1983 | Lane . | |
| 5,002,495 | 3/1991 | Tanaka | 439/181 |
| 5,242,311 | 9/1993 | Seong | 439/135 |
| 5,249,977 | 10/1993 | Tanaka et al. | 439/135 |
| 5,256,074 | 10/1993 | Tan | 439/181 |
| 5,361,492 | 11/1994 | Miyazawa | 439/135 |
| 5,571,022 | 11/1996 | Schaarschmidt | 439/135 |
| 5,674,083 | 10/1997 | Whiteman, Jr. et al. | 439/181 |
| 5,681,174 | 10/1997 | Correll, Jr. et al. | 439/135 |
| 5,899,760 | 5/1999 | Ho | 439/135 |

*Primary Examiner*—Lincoln Donovan
*Assistant Examiner*—Javaid Nasri
*Attorney, Agent, or Firm*—Michael Aronoff

[57] ABSTRACT

An electrostatic protection cover (30) for mounting onto an electrical connector (10) comprises a main body section (32) for electrically engaging contact sections (18) of electrical contacts (14), and resilient legs (34) extending from opposing sides of the main body section (32) for engaging respective sides of the electrical connector.

6 Claims, 3 Drawing Sheets

ELECTROSTATIC PROTECTION COVER FOR ELECTRICAL CONNECTOR

FIELD OF THE INVENTION

The present invention relates to electrical connectors and more particularly to electrostatic protection covers for electrical connectors; the covers can also be used for pick-and-place applications.

BACKGROUND OF THE INVENTION

Electrical contacts of electrical connectors must be electrically connected to a shunt member when the electrical connectors are electrically connected to circuit boards, especially those used in disc drives of computers to protect the electronic circuits thereof. The electrical connectors are preferably placed at selected positions on the circuit boards by pick-and-place apparatus.

U.S. Pat. Nos. 4,396,245; 5,242,311; 5,249,977; 5,571,022 and 5,681,174 disclose electrical connectors to which a cover or cap is mounted so that a suction nozzle of a suction apparatus can engage the cover or cap and via suction pick-up the electrical connectors and place them onto selected positions of a circuit board. However, none of the covers or caps described in these patents engage all the electrical contacts of the electrical connectors so as to electrically connect them together.

The electrical connector disclosed in U.S. Pat. No. 5,674,083 includes a conductive member affixed to a housing and having protrusions spaced from respective electrical contacts of the electrical connector so as to provide spark gaps between the protrusions and the electrical contacts thereby providing ESD protection when the connector is mounted at an input/output port of an apparatus. The conductive member cannot be used in conjunction with a pick-and-place apparatus and it does not electrically engage all the electrical contacts.

SUMMARY OF THE INVENTION

An object of the present invention is to provide a cover for an electrical connector that shunts all electrical contacts thereof.

Another object of the present invention is the provision of a cover for an electrical connector having a surface for engagement by a pick-and-place apparatus to place the connector onto a selected position of a circuit board.

The present invention is realized by a cover of conductive material for mounting onto an electrical connector having electrical contacts comprising a main body section for electrically engaging contact sections of the electrical contacts, and resilient legs extending from opposing sides of the main body section for engaging respective sides of the electrical connector. The main body section includes a planar surface for engagement by a suction nozzle of a suction pick-and-place apparatus to pick-up the connector and place it onto a selected position of a circuit board.

BRIEF DESCRIPTION OF THE DRAWINGS

Embodiments of the present invention will now be described by way of example with reference to the accompanying drawings in which.

DETAILED DESCRIPTION OF THE INVENTION

Figure 2:
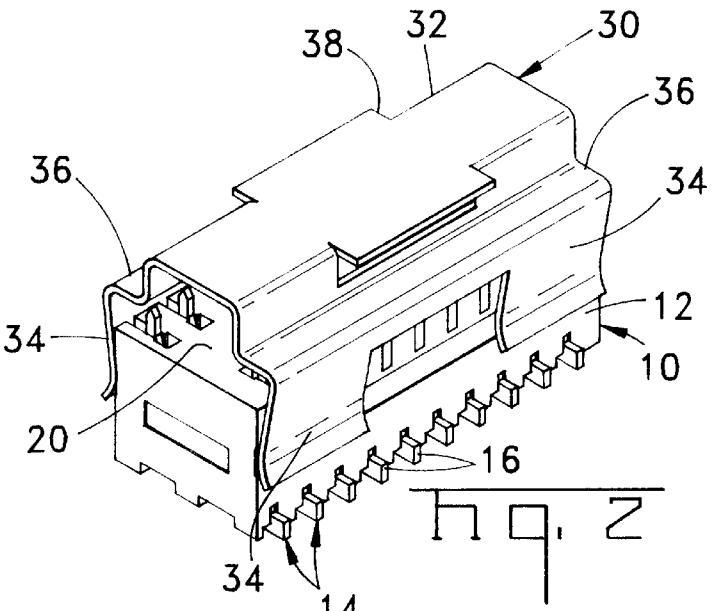
FIG. 2 is a perspective view showing the electrostatic protection cover mounted onto the electrical connector.
Figure 3:
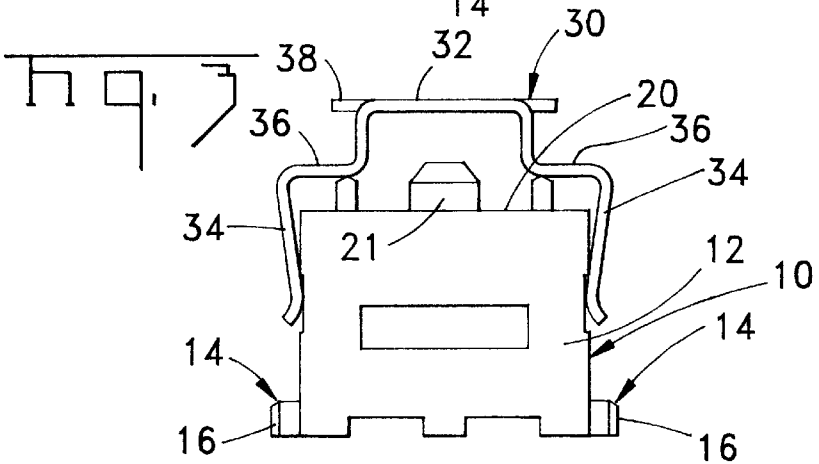
FIG. 3 is an end view of FIG. 2.
Figure 1:
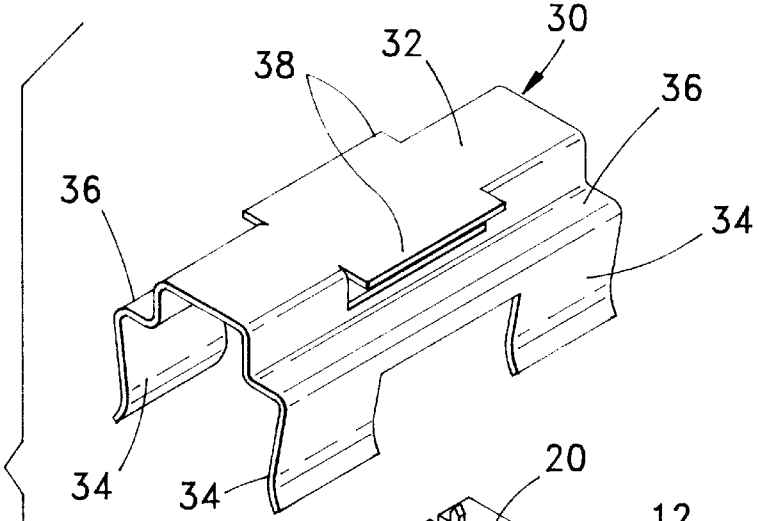
FIG. 1 is an exploded perspective view of an electrostatic protection cover and an electrical connector to which the electrostatic protection cover is to be mounted.
Figure 1:
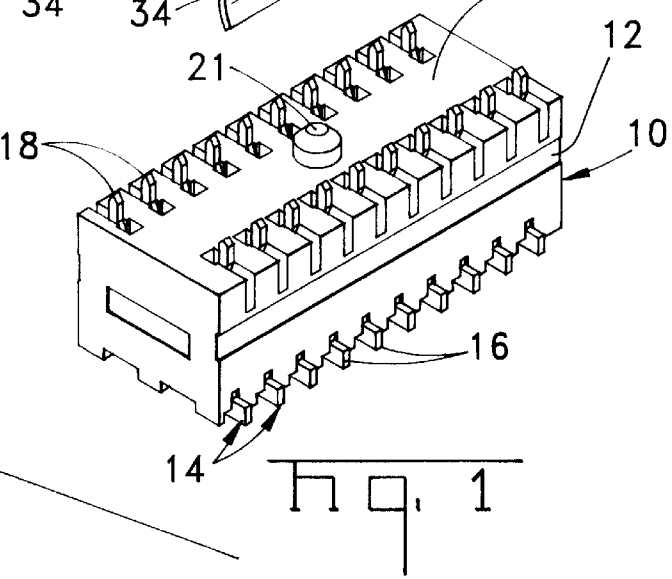

As shown in FIGS. 1–3, a surface-mounted electrical connector 10 includes a dielectric housing 12 in which surface-mounted electrical contacts 14 are secured along respective sides thereof. Electrical contacts 14 have termination sections 16 extending outwardly from side surfaces of housing 12 along bottom edges thereof and contact sections 18 extending outwardly from an upper surface 20 of the housing 12.

Electrical connector 10 is to be placed onto a circuit board (not shown) with termination sections 16 engaging respective conductive pads on the circuit board, and the termination sections 16 are to be soldered to the conductive pads by conventional soldering practices such as flow soldering.

Electrostatic protection cover 30 is stamped and formed from a metal sheet and includes a main body section 32 having a U-shape and resilient legs 34 extending from opposing sides of main body section 32. Resilient legs 34 are connected to main body section 32 by sections 36. Projections 38 are formed out of the side walls of main body section 32, and they are located in the same plane as the bottom wall of main body section 32. The bottom wall of the main body section 32 including projections 38 provides a planar surface for engagement by a suction nozzle of a pick-and-place apparatus.

Electrostatic protection cover 30 is mounted onto electrical connector 10 as shown in FIGS. 2 and 3 whereby resilient legs 34 engage respective sides of housing 12 and the junction of sections 36 with the main body section 32 electrically engage contact sections 18 thereby providing a shunt for the contact sections. The outer or free ends of the resilient legs 34 are bent outwardly to facilitate the resilient legs engaging the sides of the connector housing.

A certain or certain ones of the electrical contacts is or are connected to a ground circuit on the circuit board. Thus, the electrostatic protection cover 30 is likewise connected to the ground circuit as a result of its engagement with the contact sections 18. Accordingly, the electrical contacts 14 are connected to the ground circuit on the circuit board thereby protecting the electronic components and circuitry of the circuit board from electrostatic or other undesirable voltages.

When electrical connector 10 is to be electrically connected to another circuit board, the electrostatic protection cover 30 is removed from the electrical connector and contact sections 18 are springably electrically connected to conductive pads on the other circuit board. A protrusion 21 of circular configuration extends outwardly from upper surface 20 of housing 12 for disposition in a hole in the other circuit board to properly align the contact sections 18 with the conductive pads.

Figure 5:
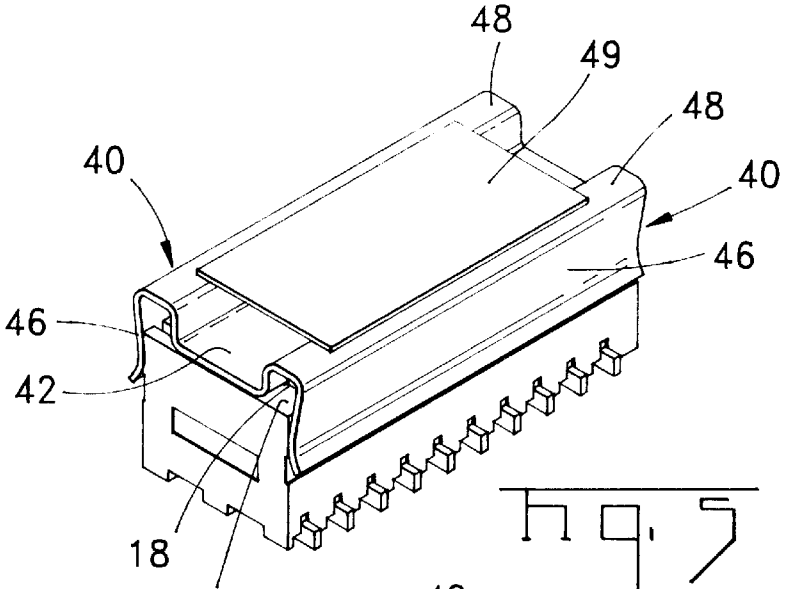
FIG. 5 is a perspective view showing the electrostatic protection cover of FIG. 4 mounted onto the electrical connector.
Figure 6:
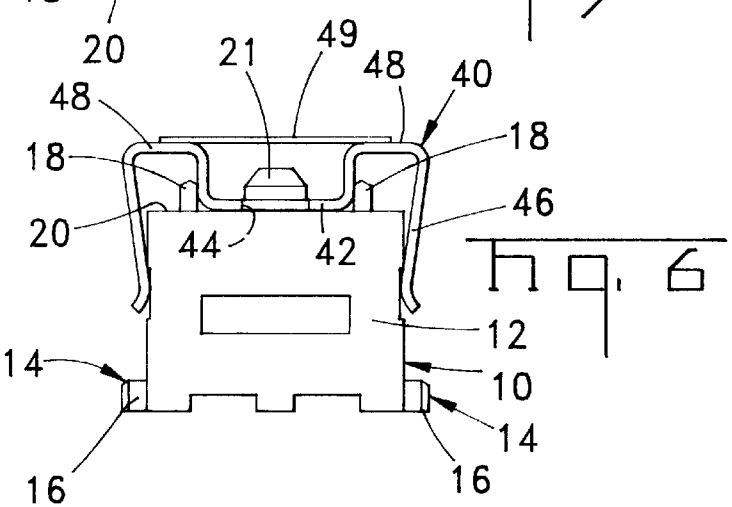
FIG. 6 is an end view of FIG. 5.
Figure 4:
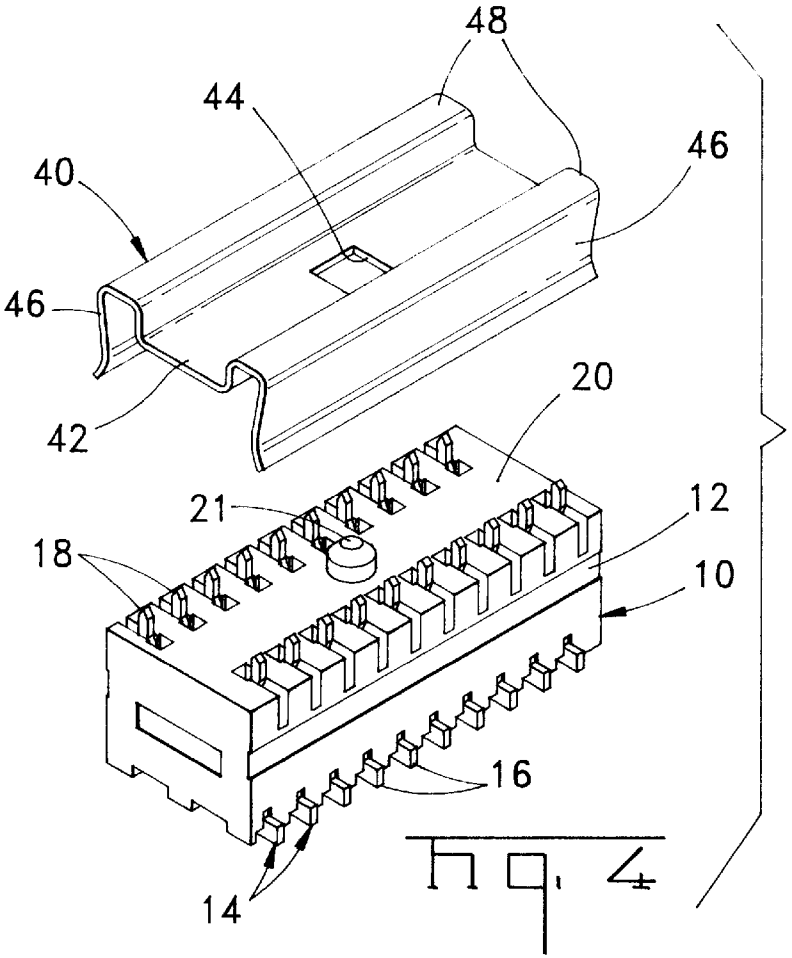
FIG. 4 is an exploded perspective view of an alternative embodiment of an electrostatic protection cover and the electrical connector to which the electrostatic protection cover is to be mounted.

FIGS. 4–6 show electrostatic protection cover 40, which is an alternative embodiment of the present invention. Electrostatic protection cover 40 is similar to electrostatic protection cover 30 of FIGS. 1–3, except that main body section 42 has a reverse orientation whereby the bottom wall thereof extends along and in engagement with the upper surface 20 of housing 12. A square hole 44 is located in the bottom wall of the main body section 42 to accommodate protrusion 21. Resilient legs 46 are connected to the sides of the main body section 42 by sections 48.

When electrostatic protection cover 40 is mounted onto the electrical connector 10 as shown in FIGS. 5 and 6, resilient legs 46 engage the sides of the housing, the bottom wall of the main body section engages the upper surface 20 and the side walls of the main body section 42 electrically engage contact sections 18 of the electrical contacts. The outer ends of the resilient legs 46 are bent outwardly to facilitate the engagement of the resilient legs with the sides of the connector housing.

The inside surface of the main body section 42 can serve as a suction nozzle engagement area of the pick-and-place apparatus so long as the suction nozzle can be used thereon. If not, a piece of tape 49, such as a high temperature polyimide tape, can be applied to sections 48 thereby serving as a suction nozzle engagement area.

Figures 7, 8:
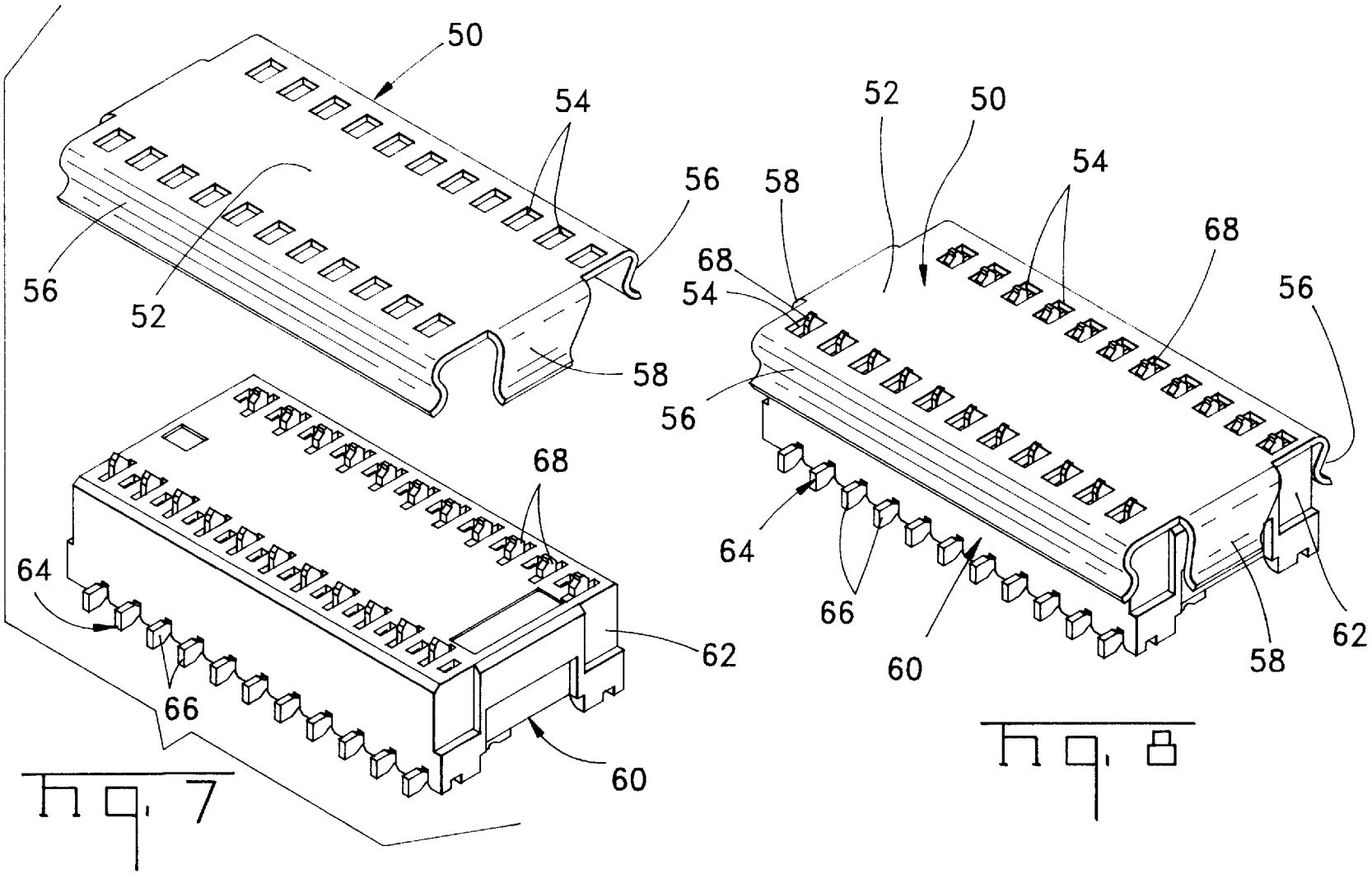
FIG. 7 is an exploded perspective view of another embodiment of an electrostatic protection cover and an electrical connector to which the electrostatic cover is to be mounted.
FIG. 8 is a perspective view showing the electrostatic protection cover of FIG. 7 mounted onto the electrical connector.

FIGS. 7 and 8 show electrostatic protection cover 50 and electrical connector 60, another embodiment of the present invention. Electrical connector 60 is a low-profile surface-mounted electrical connector, and it comprises a dielectric housing 62 and surface-mounted electrical contacts 64 are secured along each side thereof. Electrical contacts 64 include termination sections 66 extending outwardly from side surfaces of the housing and contact sections 68 extending outwardly from an upper surface of the housing.

Electrostatic protection cover 50 includes a main body section 52 of planar configuration having spaced rectangular openings 54 adjacent respective outer edges thereof, and resilient legs 56, which are bent downwardly from the sides of the main body section 52 with the free ends being bent outwardly. End resilient legs 58 extend downwardly from respective ends of the main body section 52 and their outer ends are bent outwardly.

Electrostatic protection cover 50 is mounted onto electrical connector 60 as shown in FIG. 8 with main body section 52 engaging the upper surface of housing 62, resilient legs 56 engaging the sides of the housing and end resilient legs 58 engaging the ends of the housing and contact sections 68 extending through rectangular openings 54 and electrically engaging main body section 52. The planar upper surface of the main body section 52 serves as an area for engagement by the suction nozzle of the pick-and-place apparatus. The ends of the housing 62 has recesses in which the end resilient legs 58 are received.

Embodiments of the electrostatic protection cover of the present invention have been described above. The termination sections 16, 66 and contact sections 18, 68 of the electrical contacts 14, 64 can be posts that are disposed in plated-through holes of the circuit board.

What is claimed is:

1. An electrostatic protection cover for mounting onto an electrical connector having electrical contacts, comprising a main body section for extending along an upper surface of the electrical connector and electrically engaging contact sections of the electrical contacts, the main body section including a bottom wall and a side wall extending from opposed sides of the bottom wall thereby forming a U-shaped profile, a connecting section extending outwardly from each side wall, and resilient leg extending from each of the connecting sections for engagement with respective sides of the electrical connector.

2. The electrostatic protection cover as claimed in claim 1, wherein said main body section includes a planar surface for engagement by a suction nozzle of a pick-and-place apparatus.

3. The electrostatic protection cover as claimed in claim 1, wherein the bottom wall is spaced from a terminal end of each of the electrical contacts.

4. The electrostatic protection cover as claimed in claim 1, wherein the contact sections of the electrical contacts electrically engage junctions of the sections and the side walls of the main body section.

5. The electrostatic protection cover as claimed in claim 1, wherein the bottom wall of the main body engages an upper surface of the electrical connector.

6. The electrostatic protection cover as claimed in claim 5, wherein the contact sections of the electrical contacts electrically engage side walls of the main body section.

* * * * *